US006826806B2

(12) United States Patent
Eaton et al.

(10) Patent No.: US 6,826,806 B2
(45) Date of Patent: Dec. 7, 2004

(54) BREAKAWAY CLOSURE DEVICE

(75) Inventors: Edward Eaton, Wheaton, IL (US); Richard J. Tracy, Elgin, IL (US)

(73) Assignee: Illinois Tool Works Inc., Glenview, IL (US)

( * ) Notice: Subject to any disclaimer, the term of this patent is extended or adjusted under 35 U.S.C. 154(b) by 4 days.

(21) Appl. No.: 10/392,408

(22) Filed: Mar. 19, 2003

(65) Prior Publication Data

US 2003/0217441 A1 Nov. 27, 2003

Related U.S. Application Data

(60) Provisional application No. 60/383,151, filed on May 24, 2002.

(51) Int. Cl.[7] ..... A44B 11/25

(52) U.S. Cl. ..... 24/115 F; 24/DIG. 38; 24/584.1; 24/587.12

(58) Field of Search ..... 024/3.1, 265 BC, 024/3.4, 265 EC, 584.1, 604, 625, 586.11, 629, 633, 616–618, 634, 662, 697.11, DIG. 22, 38, DIG. 39, 40, DIG. 41, 43; 224/605; 403/339, 340

(56) References Cited

U.S. PATENT DOCUMENTS 369,123 A * 8/1887 Peters ..... 403/182
1,539,744 A * 5/1925 Kelly ..... 40/303
1,962,851 A * 6/1934 Wiseman ..... 24/DIG. 22
3,357,066 A * 12/1967 Moritz ..... 403/211
4,387,490 A * 6/1983 Blackburn et al. ..... 24/265 A
4,827,578 A * 5/1989 Heckerman et al. ..... 24/265 A
4,959,891 A * 10/1990 Chou ..... 24/265 A
5,224,247 A * 7/1993 Collier
5,533,238 A * 7/1996 Say ..... 24/115 F
5,669,119 A * 9/1997 Seron ..... 24/265 H
5,671,508 A * 9/1997 Murai ..... 24/115 K
5,689,860 A * 11/1997 Matoba et al. ..... 24/115 F
5,729,877 A * 3/1998 Kong et al. ..... 24/625
6,044,527 A * 4/2000 Ishida et al. ..... 24/115 F
6,073,317 A * 6/2000 Barison ..... 24/115 F
6,161,266 A * 12/2000 Anscher ..... 24/625
6,618,910 B1 * 9/2003 Pontaoe ..... 24/115 H
2003/0033697 A1 * 2/2003 Hicks et al.
2003/0121125 A1 * 7/2003 Raia et al.

* cited by examiner

*Primary Examiner*—Robert J. Sandy
(74) *Attorney, Agent, or Firm*—Mark W. Croll; Paul F. Donovan

(57) ABSTRACT

A breakaway closure device that includes the use of a pair of hermaphroditic clips that attach to the ends of a strap, such as a lanyard cord, and also engage with each other. Each hermaphroditic clip includes both a projection and an aperture that permit the hermaphroditic clips to snap together and form a releasable pair of clips. Each hermaphroditic clip further includes a plurality of interlocking pins and receptacles for securing the clip onto the end of the lanyard cord. Each hermaphroditic clip also includes a guidance lug and a plurality of interlocking lugs and openings to facilitate the easy attachment of the clip to the cord ends by hand without the use of special tools.

15 Claims, 10 Drawing Sheets

BREAKAWAY CLOSURE DEVICE

CROSS REFERENCE TO RELATED APPLICATION

This Non-Provisional Application claims benefit to U.S. Provisional Application Ser. No. 60/383,151 filed May 24, 2002.

FIELD OF THE INVENTION

The present invention relates generally to breakaway closure devices, such as, for example breakaway closures for lanyards or other straps.

BACKGROUND OF THE INVENTION

A lanyard is a small cord or rope typically used in securing or suspending a small object around a person's neck. The use of webbing, ribbon and cordage based lanyards are known and have increased in use and become more widespread over the years. The most common use of these known lanyards is for suspending identification tags or badges, or displaying various documents, often in places that require controlled access.

These known lanyards, however, have presented certain safety issues for manufacturers of such products. The common form of the lanyard, especially those intended for use around a person's neck, poses a potential risk to the wearer. Should the lanyard become entangled or pulled on in any way, a choking hazard will exist for the wearer.

In an effort to overcome this known problem, lanyard manufacturers have developed lanyards with a breakaway feature, or similar means of allowing the cordage member of the lanyard to separate at a predetermined tension level. Many techniques for permitting the lanyard to separate at a predetermined tension level are known. These include, for example, using hook and loop type fastening (e.g., Velcro™), separable metal clips, and a variety of injection molded plastic, multi-component "plug and socket" parts. There are however several disadvantages and problems with the known lanyard breakaway techniques. As an example, many of the known techniques require several different components, resulting in higher complexity of the product and increased difficulty in the use of the product. In addition, many of the known breakaway techniques are unreliable, have a high initial purchase cost, and an overall high cost application.

The present invention is directed at overcoming these and other known problems and disadvantages with existing lanyard breakaway techniques while still providing the desired separation of the lanyard cord.

SUMMARY OF THE INVENTION

The present invention includes the use of a hermaphroditic clips, that when used in a pair and attached to the cord of the lanyard will mate with themselves to create a breakaway lanyard cord. Stated another way and more specifically, the present invention includes the use of two substantially identical clips attached to the ends of the lanyard cord, with each clip having both a male projection and a female aperture. Once attached to the ends of the lanyard cord, these identical clips will snap together and form a releasable pair of clips and consequently a breakaway lanyard cord that will separate at a predetermined tension level. Significantly, each clip is easily attached by hand to the lanyard cord and the installation of each clip does not require the use of special tools.

Other features and advantages of the invention will become apparent to those skilled in the art upon review of the following detailed description, claims and drawings in which like numerals are used to designate like features.

Figure 1:
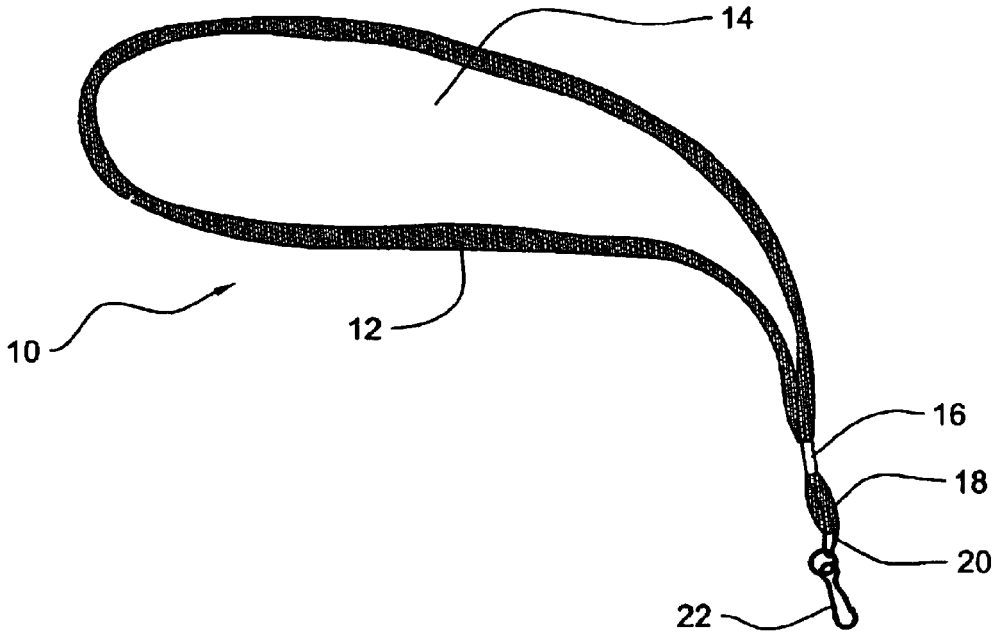
FIG. 1 (Prior Art)
FIG. 1 is a plan view of a prior art lanyard.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "compromising" and variations thereof is meant to encompass the items listed thereafter and equivalents thereof as well as additional items and equivalents thereof.

DETAILED DESCRIPTION OF THE PREFERRED EMBODIMENTS

Referring to FIG. 1, there is depicted a prior art lanyard 10 typically used to secure or suspend from a person's neck a small object, such as an identification badge or tag. The lanyard 10 includes a cord or webbing or strapping material 12 that forms a large loop 14 that, in use, is placed over a person's head and around the neck. The lanyard 10 further includes a cylindrical collar 16 that when tightly placed around two portions of the cord 12 forms a second smaller loop 18. As depicted in FIG. 1, a ring 20 and a closable clasp 22 are connected to the smaller loop 18. In use, the closable clasp 22 serves to connect an identification tag or similar object, not shown, to the lanyard 10. As one of skill in the art will readily understand, the prior art lanyard 10, and specifically the large loop 14 formed by the lanyard 10, does not include any means for permitting the cord 12 of the lanyard to break away from itself. As should be apparent, the absence of this breakaway feature creates a potential choking hazard if the lanyard becomes tangled or pulled on in any manner. The present invention overcomes these known problems.

Figure 2:
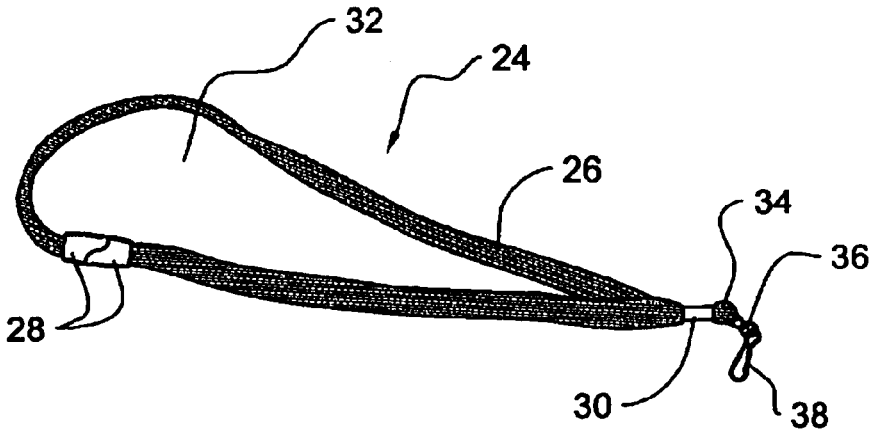
FIG. 2 is a plan view of the lanyard and breakaway closure of the present invention in a closed position.

Referring to FIG. 2, the present invention includes a lanyard 24 having a cord or web or strap material 26 and a pair of hermaphroditic clips 28 connected to the cord 26. As conventional, the lanyard 24 includes a cylindrical collar 30 that is tightly placed around two portions of the cord 26 to define a large loop 32 and a small loop 34. The large loop 32 is sufficiently sized to permit placement of the lanyard 24 over the wearer's head and around the neck. Also, as conventional, the small loop 34 is sized to receive a ring 36 and closable clasp 38 onto which may be connected an identification tag or similar object.

Figure 3:
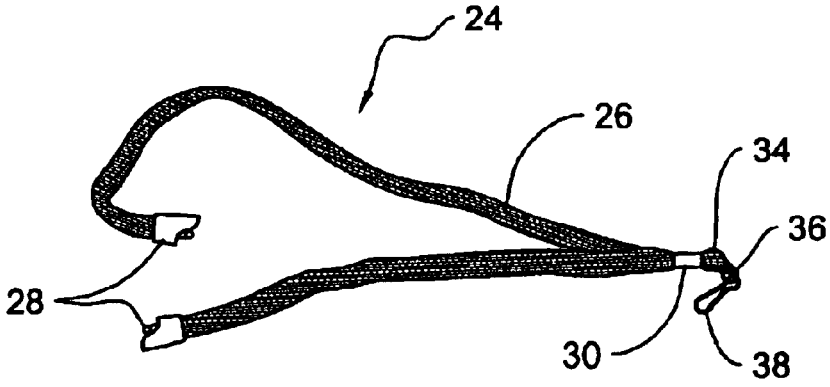
FIG. 3 is a plan view of the lanyard and breakaway closure of the present invention in an open position.

Referring to FIG. 3, the lanyard 24 is depicted with the hermaphroditic clips 28 separated from each other. The clips 28 will separate after a predetermined level of tension is applied to the cord 26. Significantly, the clips 28 permit the lanyard cord 26 to breakaway from itself so as to prevent a choking hazard for the wearer of the lanyard 24. In an exemplary embodiment, the clips 28 are substantially identical to each other with each clip containing both an aperture and a projection, discussed below.

Figure 4:
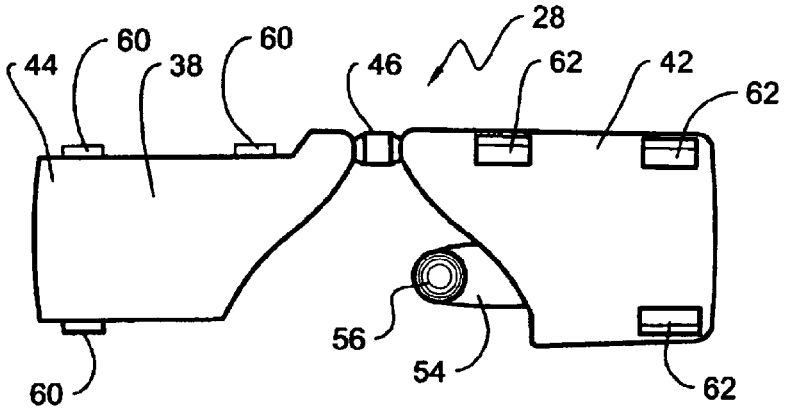
FIG. 4 is a plan view of the exterior side of the hermaphroditic clip of the present invention.
Figure 5:
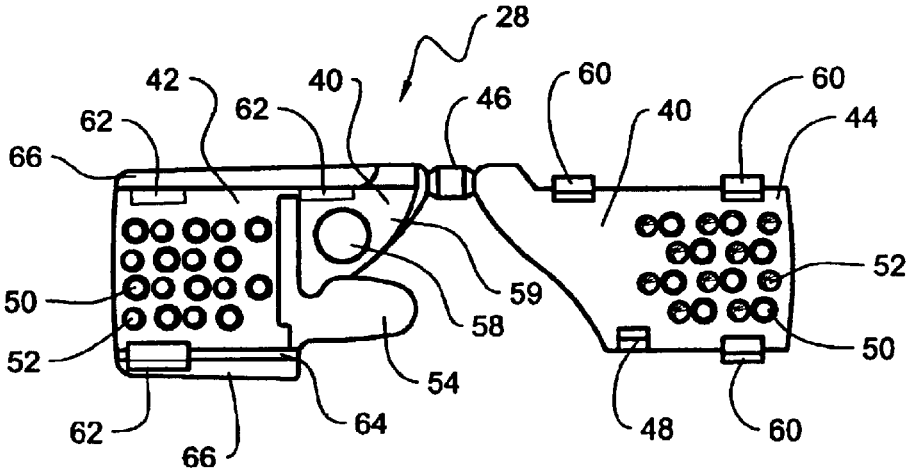
FIG. 5 is a plan view of the interior side of the hermaphroditic clip of the present invention.
Figure 6:
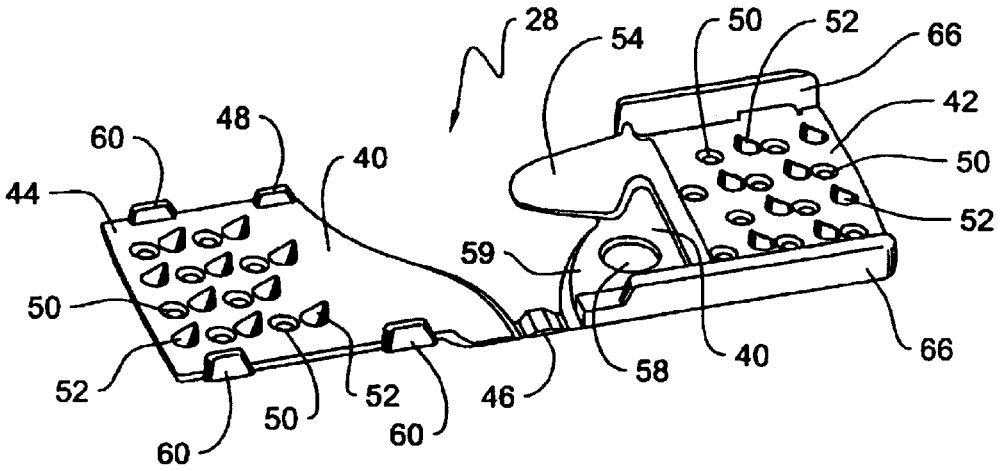
FIG. 6 is an isometric view of the hermaphroditic clip of FIG. 5.

Referring to FIGS. 4–6, an exemplary embodiment of the hermaphroditic clip 28 is depicted in an open, unattached and unsnapped position. In the open, unattached and unsnapped state, the clip 28 defines an outer wall 38, an inner wall 40, and opposing ends 42, 44. Located between and connecting the opposing ends 42, 44 of the clip 28 is a hinge 46 that permits the opposing ends 42, 44 to fold together. As shown in FIGS. 5 and 6, the clip 28 includes an integral guidance lug 48, which, in use, engages a slot 64 and automatically aligns the opposing ends 42, 44 of the clip 28 when the clip 28 is folded together and attached to the cord 26 of the lanyard 24. The clip 28 is preferably made from a plastic material, or similar suitable material.

Referring to FIGS. 5 and 6, the clip 28 also includes on the inner wall 40 a plurality of receptacles 50 and conical shaped interlocking pins 52 that are spaced apart in an array. These receptacles 50 and pins 52 are located on both ends 42, 44 of the clip 28 and are positioned on the clip 28 such that when the clip is folded at the hinge 46 and over the cord 26, the plurality of receptacles 50 and pins 52 mate with each other. In use, the mated plurality of receptacles 50 and pins 52 will trap and secure the cord 26 to the clip 28 and will prevent movement of the cord 26 relative to the clip 28 under an applied tension. In other words, when the ends 42, 44 of the clip 28 are folded onto the cord 26, the interlocking pins on one end of the clip 28 will extend into and mate with the receptacles on the opposing end of the clip 28 to securely hold the clip 28 onto the cord 26, thereby preventing the cord 26 from being pulled out of the clip 28 under tension. With the pins 52 extending into the receptacles 50 the resistance to bending of the pins, and subsequent premature pull out of the cord 26 is greatly improved. It should be understood that while the disclosed plurality of pins 52 have a conical shape, the pins may take on other various shapes and still achieve the desired securement of the cord 26 to the clip 28. It should also be understood that other arrays and configurations of the receptacles and pins are possible and may be used with the present invention.

Referring again to FIGS. 4–6, the hermaphroditic clip 28 includes a projection 54 extending outwardly from the end 42 of the clip 28. A round protuberance 56 is located at the end of the projection 54. The hermaphroditic clip 28 further includes an indent or an aperture 58 formed in the wall on the inner side 40 of the clip 28. In use, when the clip 28 is folded at the hinge 46, the projection 54 will extend outwardly from the end 42 of the clip 28. In addition, an opening 59 will form between the inner walls 40 of the opposing ends 42, 44 of the clip 28 to receive the projection 54 of an adjoining clip 28. That is, the projection 54 and accompanying protuberance 56 of one clip 28 is insertable into the opening 59 in the adjoining clip 28 with the protuberance 56 seating into the aperture 58 of the adjoining clip 28. This arrangement allows two identical clips 28 to snap together and form a releasable pair of clips.

The hermaphroditic clip 28 further includes a plurality of locking lugs 60 located around the periphery of the clip 28. These locking lugs 60 are received within a plurality of openings 62 also located around the periphery of the clip 28 when the clip 28 is folded at the hinge 46. These plurality of locking lugs 60 and openings 62 permit the opposing ends 42, 44 of the clip 28 to interlock and snap together. The clip 28 also includes opposing side walls 66 that form a channel therebetween to receive and align the cord 26 onto the plurality of receptacles 50 and pins 52.

Figure 7:
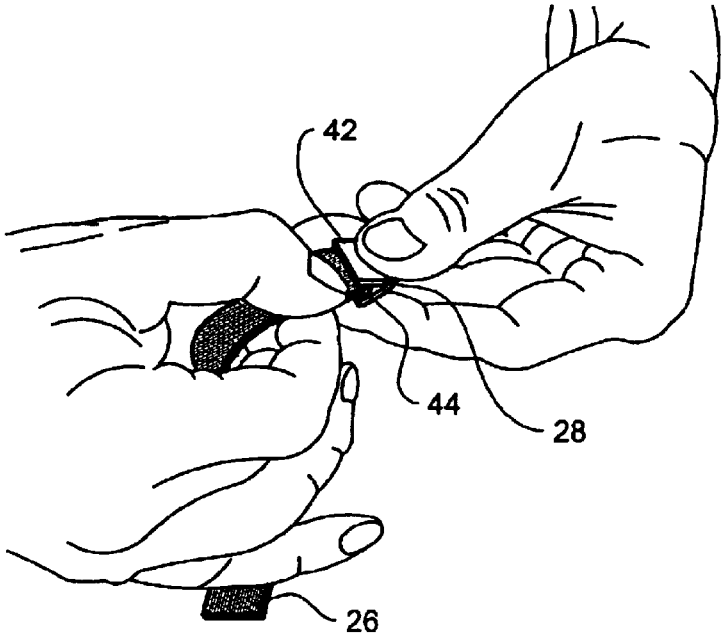
FIG. 7 depicts the assembly of the hermaphroditic clip of the present invention onto the cord or webbing material of the lanyard.

As depicted in FIG. 7, the interlocking of the opposing ends 42, 44 of the clip 28 is easily accomplished by hand without the use of special tools. The cord 26 is inserted between the opposing ends 42, 44 of the clip 28. The clip 28 is folded at the hinge 46 with the guidance lug 48 automatically aligning the opposing ends 42, 44 together. The receptacles 50 and pins 52 on the inner side 40 of the clip 28 secure the cord 26 in position by trapping the cord 26 between engaging receptacles 50 and pins 52. The receptacles 50 and pins 52 will prevent movement of the cord 26 relative to the clip 28. The plurality of locking lugs 60 and openings 62 positioned along the periphery of the clip 28 interlock with each other and by merely applying hand pressure to the opposing ends 42, 44, cause the opposing ends 42, 44 to snap together. The clip 28 of the present invention is therefore more readily installed than other known breakaway devices because of this ergonomically advantageous assembly.

Figure 8:
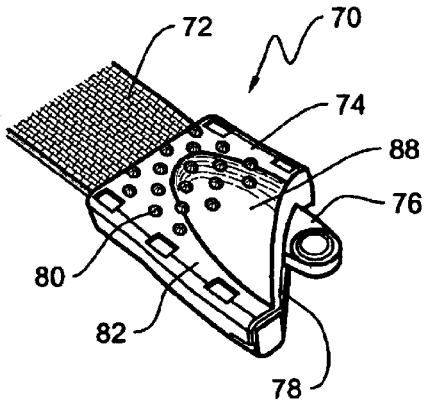
FIG. 8 is an isometric top view of another embodiment of the hermaphroditic clip of the present invention in an unsnapped position.
Figure 8:
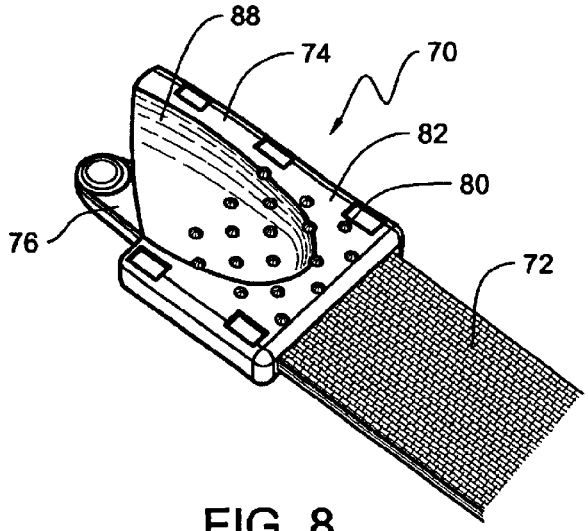
Figure 9:
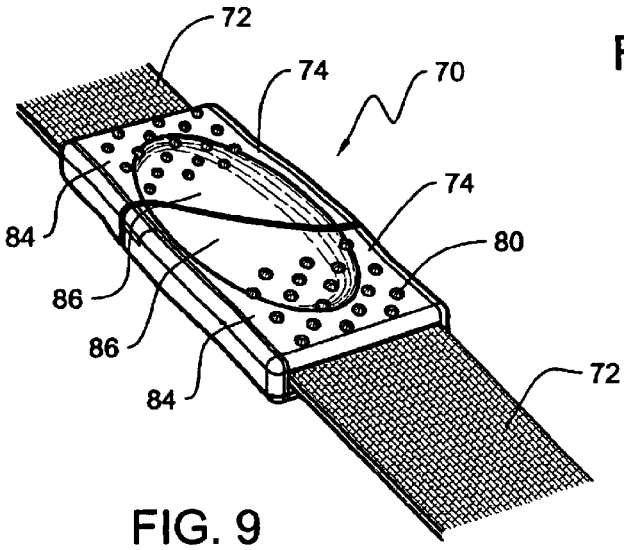
FIG. 9 is an isometric bottom view of the invention of FIG. 8 in a snapped position.
Figure 10:
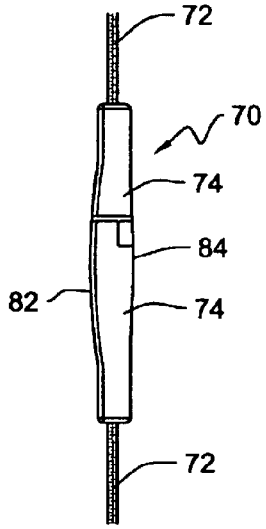
FIG. 10 is a side view of the invention of FIG. 8 in a snapped position.
Figure 11:
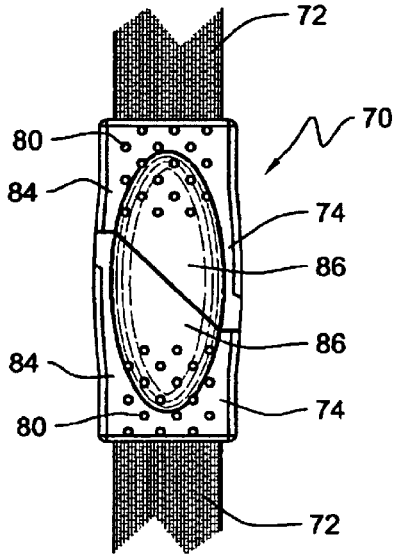
FIG. 11 is a bottom plan view of the invention of FIG. 8 in a snapped position.
Figure 12:
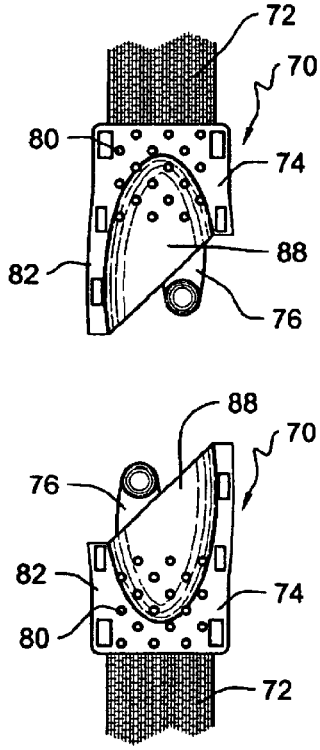
FIG. 12 is a top plan view of the invention of FIG. 8 in an unsnapped position.
Figure 13:
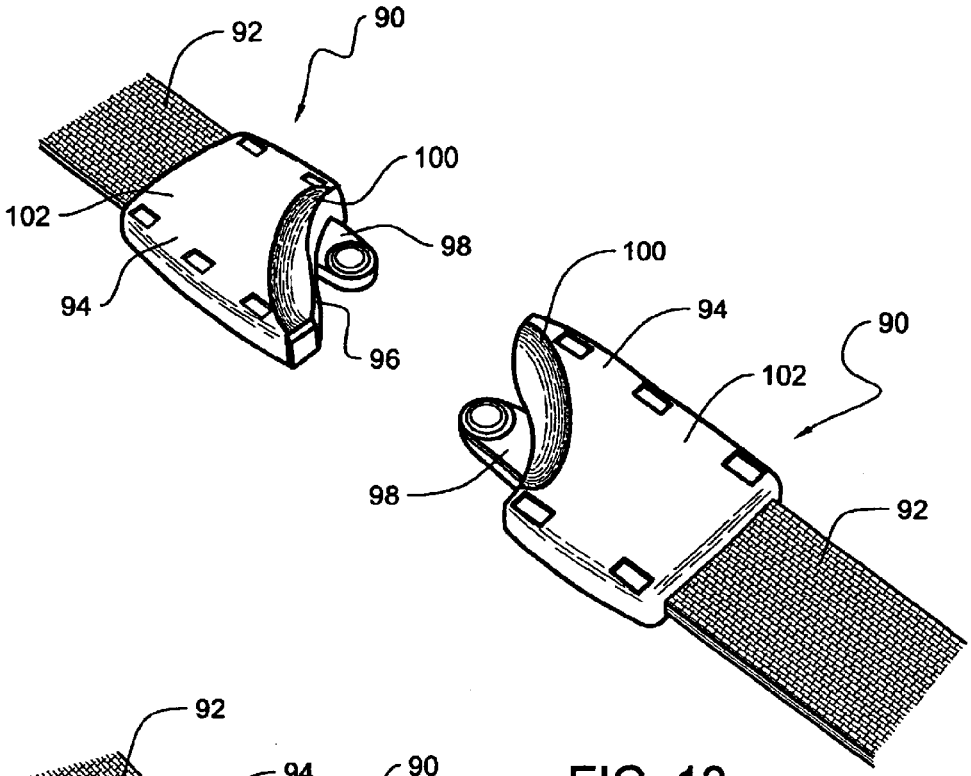
FIG. 13 is an isometric top view of another embodiment of the hermaphroditic clip of the present invention in an unsnapped position.
Figure 14:
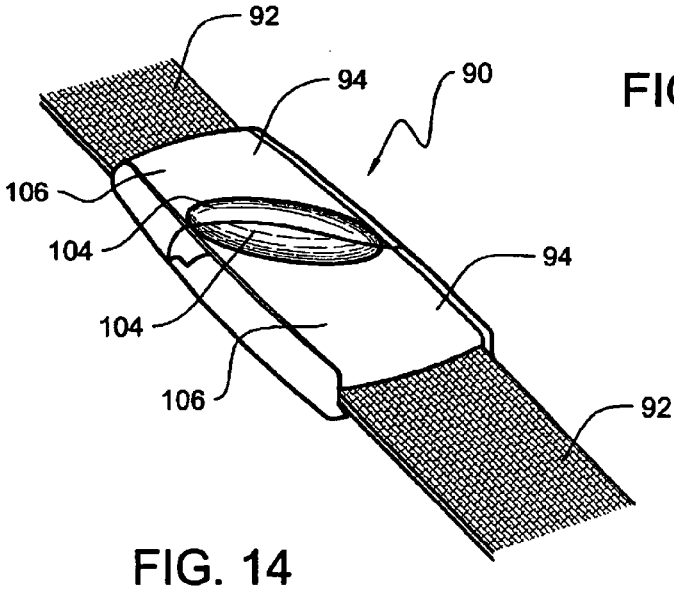
FIG. 14 is an isometric bottom view of the invention of FIG. 13 in a snapped position.
Figure 15:
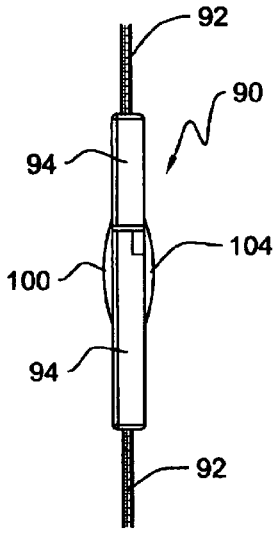
FIG. 15 is a side view of the invention of FIG. 13 in a snapped position.
Figure 16:
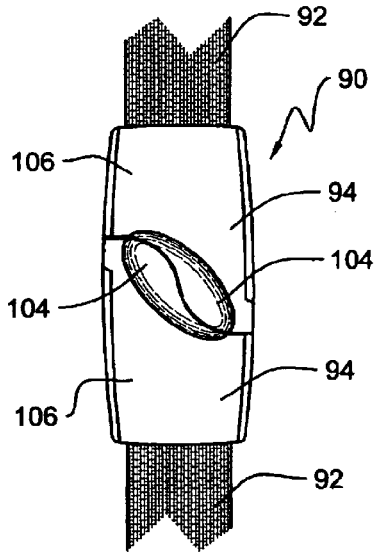
FIG. 16 is a bottom plan view of the invention of FIG. 13 in a snapped position.
Figure 17:
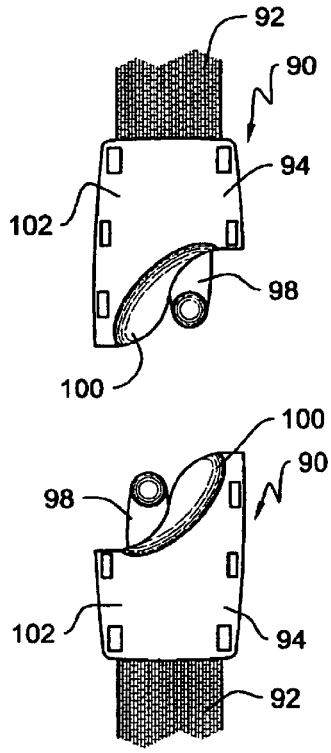
FIG. 17 is a top plan view of the invention of FIG. 13 in an unsnapped position.

It should be readily apparent to one of skill in the art that other shapes, designs, and features of the hermaphroditic clips are possible with the present invention. For example, referring to FIGS. 8–12, another exemplary embodiment of the invention includes a lanyard 70 having a cord or web material 72 and a pair of hermaphroditic clips 74 secured to the ends of the cord 72 in the manner described above. As above, and depicted in FIGS. 8 and 12, each of the hermaphroditic clips 74 are substantially identical and include a projection 76 and opening 78 for permitting the substantially identical clips 74 to snap together, in the manner described above, to form a releasable pair of clips. Many of the features of the hermaphroditic clip 74 are common with the features of the hermaphroditic clip 28 described above and depicted in FIGS. 4–6 and will not be described again. The embodiment shown in FIGS. 8–12 includes features that make the hermaphroditic clips 74 ergonomically advantageous. Specifically, the hermaphroditic clips 74 include the use of gripping elements 80 located on the exterior of the clip body. As depicted, the gripping elements 80 may include a plurality of holes positioned across the top surface 82 and bottom surface 84 of the clip body to function as a gripping surface to further aid in the snap fitting of the hermaphroditic clips 74. It should be understood that other gripping elements 80 or a gripping surface may be used with and is considered a part of the present invention. A recess surface 86 is located in the bottom surface 84 and an extending surface 88 is located on the top surface 82 of each of the hermaphroditic clips 74. These surfaces 86, 88 also assist in the snap fitting of the hermaphroditic clips 74 by the user.

Referring to FIGS. 13–17, yet another exemplary embodiment of the invention includes a lanyard 90 having a cord or web material 92 and a pair of hermaphroditic clips 94 secured to the ends of the cord 92 in the same manner described above. As with the previously described embodiments, the hermaphroditic clips 94 are substantially identical and each include an opening 96 and a projection 98 that permit the snap fitting of the clips 94 together. Again, the hermaphroditic clips 94 will release after a predetermined level of tension is applied to the clips 94. Many of the features of the hermaphroditic clips 94 are common with the clips of the previous embodiments and will not be described in detail again. Features unique to the embodiment depicted in FIGS. 13–17 include the ergonomically advantageous arc-shaped extending surface 100 on the top surface 102 and the arc-shaped extending surface 104 on the bottom surface 106. Together these extending surfaces 100, 104 assist the user in snap-fitting the hermaphroditic clips 94 together.

Figure 18:
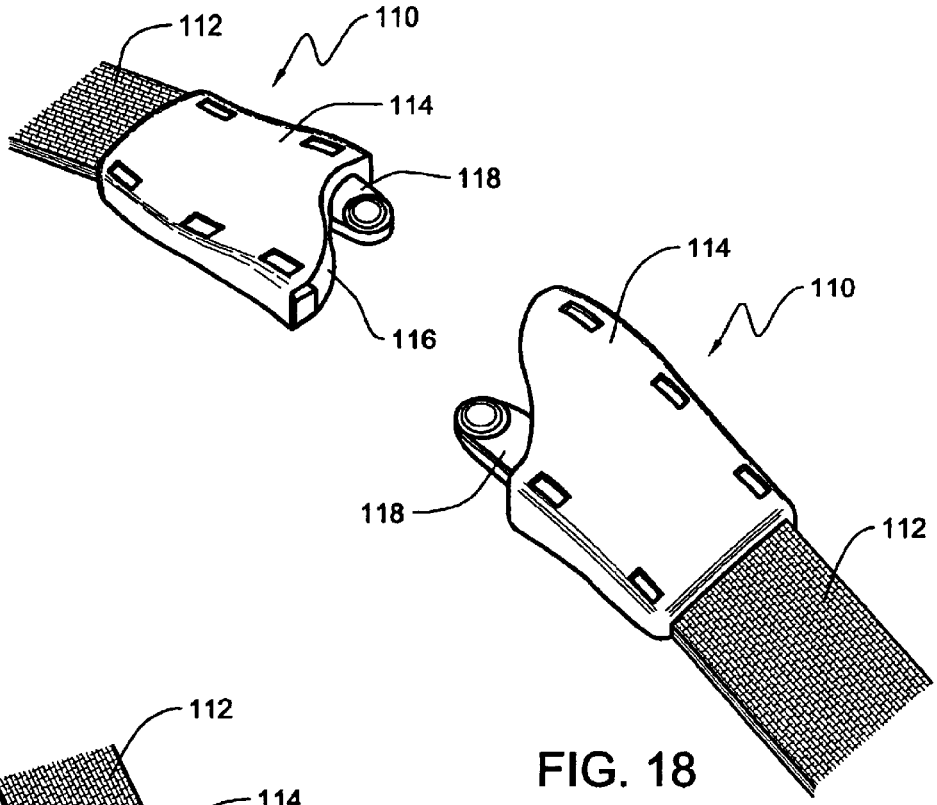
FIG. 18 is an isometric top view of another embodiment of the hermaphroditic clip of the present invention in an unsnapped position.
Figure 19:
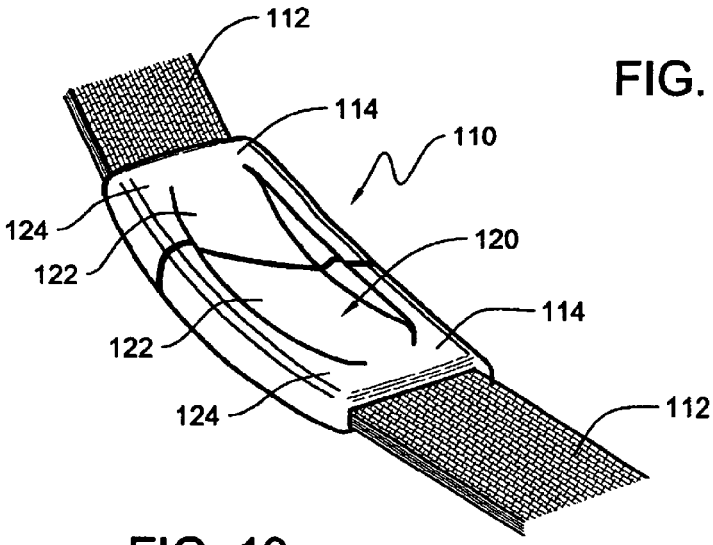
FIG. 19 is an isometric bottom view of the invention of FIG. 18 in a snapped position.
Figure 20:
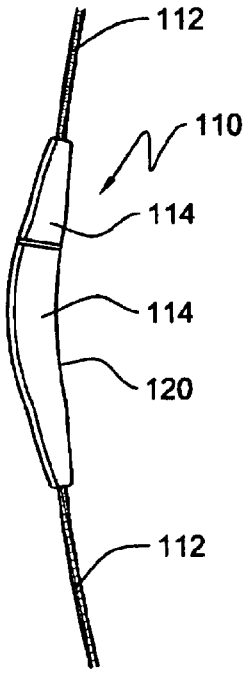
FIG. 20 is a side view of the invention of FIG. 18 in a snapped position.
Figure 21:
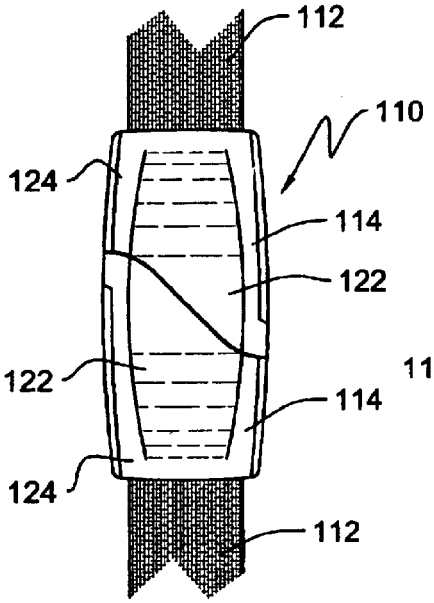
FIG. 21 is a bottom plan view of the invention of FIG. 18 in a snapped position.
Figure 22:
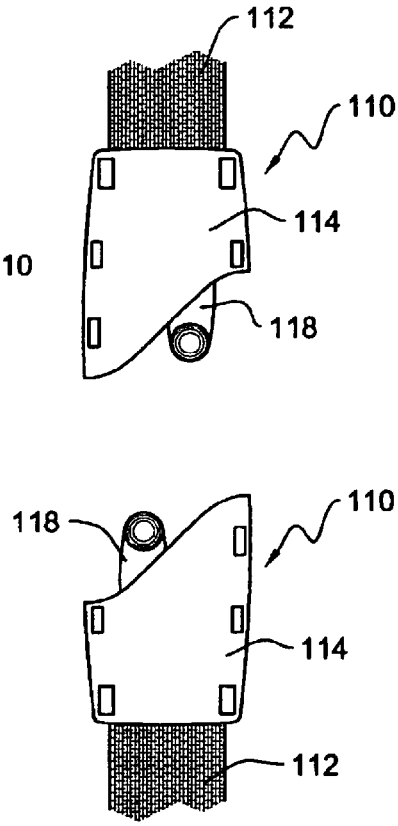
FIG. 22 is a top plan view of the invention of FIG. 18 in an unsnapped position.

Referring to FIGS. 18–22, still another exemplary embodiment of the invention includes a lanyard 110 having a cord or web material 112 and a pair of hermaphroditic clips 114 secured to the ends of the cord 112 in the manner described above. Similar to the previously described embodiments, the hermaphroditic clips 94 are substantially identical and each include an opening 116 and a projection 118 that permit the snap fitting of the clips 114 together. As with the other embodiments, the hermaphroditic clips 114 will release after a predetermined level of tension is applied to the clips 114. Again, the hermaphroditic clips 114 have features common with the hermaphroditic clips described above and will not be repeated here. As shown in FIGS. 18–20, each of the hermaphroditic clips 114 are curve shaped such that when a pair of clips 114 are snapped together they define a curve shaped or arc shaped profile 120 which, in use, more closely matches the curvature of the loop formed by the lanyard cord 112. The resulting construction provides for a comfortable fit of the lanyard 110 around the wearer's neck. The hermaphroditic clips 114 further define a recess 122 on the bottom surface 124 of the clips 114 to assist the user in snap-fitting the clips 114 together.

Variations and modifications of the foregoing are within the scope of the present invention. For example, although the invention has been described in detail in connection with a lanyard, the invention is capable of use in other applications, such as, for example, shoulder straps or other assemblies using straps, and the lanyard is merely shown and described as an example of one such application. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A breakaway closure device for a cord or the like having a first end and a second end, the device comprising:

a first clip removably attached to the first end of the cord, the first clip having an outer wall, an inner wall, a first end, a second end opposite the first end, a hinge located between and connecting the first and second ends so as to permit the opposing ends to fold together, a projection extending outwardly from the first end and an aperture formed in the inner wall of the first end, the first clip further defining an opening formed between the inner wall of the first end and the inner wall of the second end when the first end and the second end are folded together; and a second clip removably attached to the second end of the cord, the second clip also having an outer wall, an inner wall, a first end, a second end opposite the first end, a binge located between and connecting the first and second ends so as to permit the opposing ends to fold together, a projection extending outwardly from the first end and an aperture formed in the inner wall of the first end, the second clip further defining an opening formed between the inner wall of the first end and the inner wall of the second end when the first end and the second end are folded together, wherein the projection of the first dip is received within the opening of the second clip and engages the aperture of the second clip, and the projection of the second clip is received within the opening of the first clip and engages the aperture of the first clip.

2. The device as set forth in claim 1, wherein the first end and second end of the first clip further include a plurality of receptacles and pins.

3. The device as set forth in claim 2, wherein the cord is placed between the plurality of receptacles and pins of the first clip.

4. The device as set forth in claim 1, wherein the first end and second end of the first clip and the first end and second end of the second clip further include a plurality of receptacles and pins.

5. The device as set forth in claim 4, wherein the first end of the cord is placed between the plurality of receptacles and pins of the first clip and the second end of the cord is placed between the plurality of receptacles and pins of the second clip.

6. The device as set forth in claim 1, wherein the first clip and second clip include a guidance lug and a slot for engaging the guidance lug.

7. The device as set forth in claim 6, wherein the first clip and second clip include a plurality of locking lugs and a plurality of openings for receiving the plurality of locking lugs.

8. The device as set forth in claim 7, wherein the first clip and second clip include a top surface and a bottom surface, the top surface including an extending surface and the bottom surface including a recess surface.

9. The device as set forth in claim 7, wherein the first clip and second clip include a top surface and a bottom surface, the top and bottom surfaces including gripping elements.

10. The device as set forth in claim 7, wherein the first clip and second clip define a curve shaped profile.

11. The device as set forth in claim 1, wherein each of the clips includes a plurality of receptacles and pins formed in a spaced apart array, the receptacles and pins being located and positioned on both ends of each clip such that when the ends are folded together, the plurality of receptacles mate with the pins.

12. The lanyard as set forth in claim 11, wherein the first end and the second end of the lanyard cord is secured between the plurality of receptacles and pins of the clips.

13. The lanyard as set forth in claim 11, wherein the pair of clips includes a top surface and a bottom surface, the top surface including an extending surface and the bottom surface including a recess surface, the top and bottom surfaces also including gripping elements.

14. The lanyard as set forth in claim 11, wherein the pair of clips define a curve shaped profile.

15. A means for releasably closing a lanyard cord, the means comprising:

means for providing a lanyard cord having a first end and a second end;

means for providing a first clip and a second clip, each clip including a projection, an aperture, a hinge, and a plurality of lanyard engaging members;

means for placing the first end of the lanyard cord between the plurality of lanyard engaging members of the first clip;

means for folding the first clip over the first end of the lanyard cord and about the hinge of the first clip;

means for snap-fitting the first clip onto the first end of the lanyard cord;

means for placing the second end of the lanyard cord between the plurality of lanyard engaging members of the second clip;

means for folding die second clip over the second end of the lanyard cord and about the hinge of the second clip;

means for snap-fitting the second clip onto the second end of the lanyard cord;

means for inserting the projection of the first clip into the aperture of the second clip;

means for inserting the projection of the second clip into the aperture of the first clip;

wherein the plurality of lanyard engaging members include a plurality of conical shaped pins and a plurality of receptacles for receiving the plurality of conical shaped pins, and wherein each of the first and second clips include a guidance lug and a plurality of locking lugs for facilitating the snap-fitting of each of the first and second clips onto the respective first and second ends of the lanyard cord.

* * * * *